US005836222A

United States Patent [19]

Harpell

[11] Patent Number: 5,836,222

[45] Date of Patent: Nov. 17, 1998

[54] SHINGLE REMOVING TOOL

[76] Inventor: William Harpell, 2380 Findlay Road, Jocyeville, Ontario, Canada, K0H 1Y0

[21] Appl. No.: 728,162

[22] Filed: Oct. 9, 1996

[30] Foreign Application Priority Data

Oct. 12, 1995 [CA] Canada ..... 2160399

[51] Int. Cl.[6] ..... E04D 15/02

[52] U.S. Cl. ..... 81/45; 254/131.5

[58] Field of Search ..... 81/45, 46; 30/169, 30/172; 254/18, 21, 25, 131, 131.5; D8/88, 89

[56] References Cited

U.S. PATENT DOCUMENTS

| | | | |
|---|---|---|---|
| 730,781 | 6/1903 | Mitchell | 81/45 |
| 752,615 | 2/1904 | Cokefair | 81/45 |
| 1,218,145 | 3/1917 | Whittier | 81/45 |
| 3,987,827 | 10/1976 | Mills . | |
| 4,086,699 | 5/1978 | Olkkola | 254/131.5 X |
| 4,182,390 | 1/1980 | Renner . | |
| 4,663,995 | 5/1987 | Amundson et al. . | |
| 4,821,609 | 4/1989 | Rushbrook . | |
| 5,009,131 | 4/1991 | Alto et al. | 81/45 |
| 5,010,791 | 4/1991 | Williams . | |
| 5,159,859 | 11/1992 | Whitesell . | |
| 5,280,676 | 1/1994 | Fieni | 81/45 X |

FOREIGN PATENT DOCUMENTS 25120878 10/1994 Canada .

*Primary Examiner*—D. S. Meislin

[57] ABSTRACT

A shingle removing tool having, in a first embodiment, a generally flat blade with a handle attached to one end of the blade at a shallow angle. The blade has a set of slots in its front edge and at least two slots in its back edge for use in removing shingle nails from the shingles or roof. In a second embodiment, the tool has a generally flat blade with two, spaced-apart, elongate fingers projecting forwardly from the front edge of the blade. The fingers provide a tool with better leverage for lifting off shingles. A set of slots are provided in the front edge of the blade between the fingers and at least two slots are in the back edge for use in removing shingle nails. In a third embodiment, a shingle cutting tool is provided having top and bottom blades joined together with a central, vertical flange. A cutting edge on the front of the flange cuts shingles between the blades as the tool is pushed forward.

7 Claims, 5 Drawing Sheets

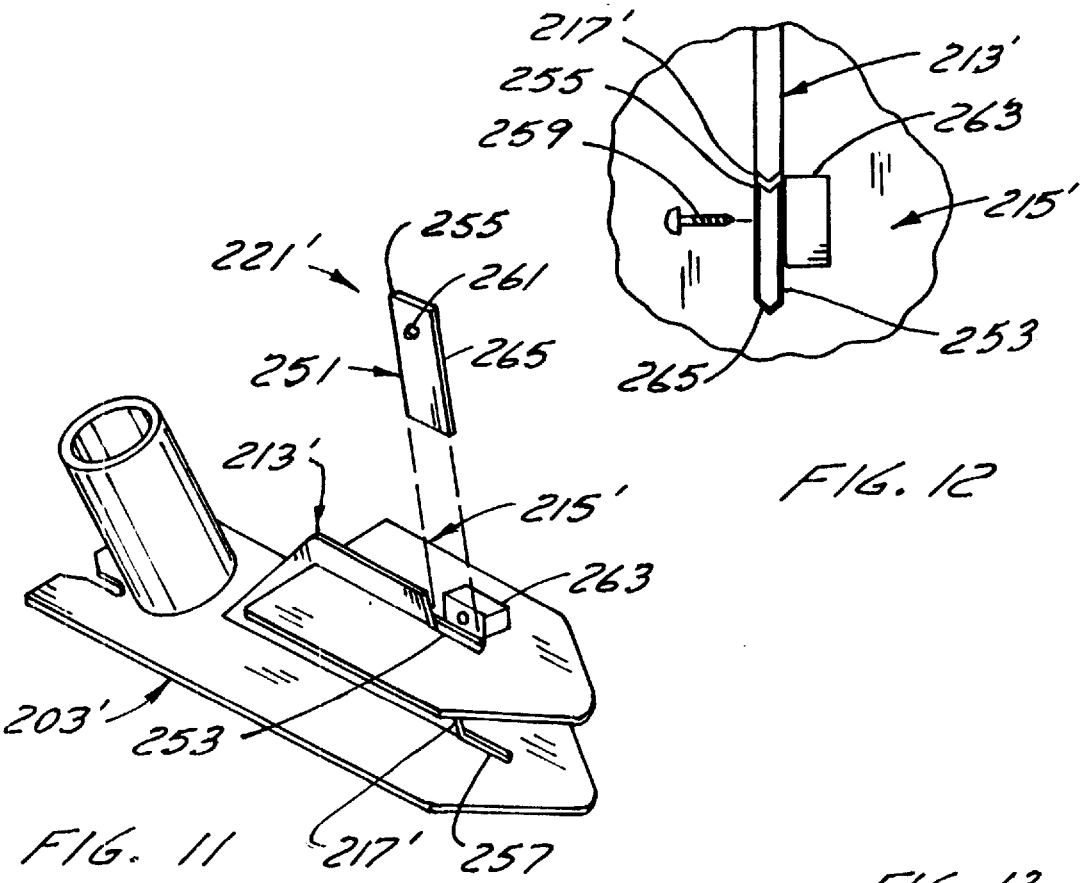
FIG. 11
FIG. 12
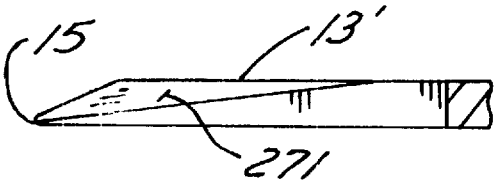
FIG. 14
FIG. 13
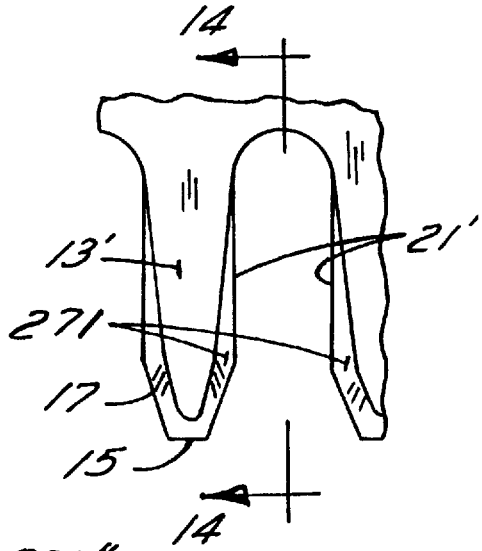
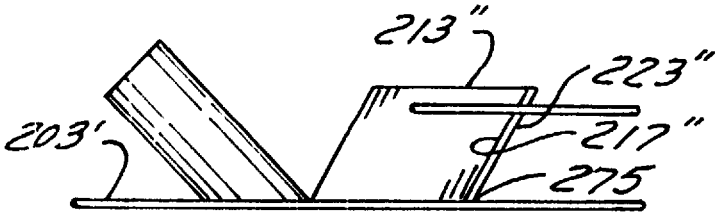
FIG. 15

SHINGLE REMOVING TOOL

BACKGROUND OF THE INVENTION

1. Field of the Invention

This invention is directed toward shingle removing tools.

The invention is more particularly directed toward shingle removing tools for removing shingles from a roof.

2. Description of the Related Art Including Information Disclosed Under CFR §§ 1.97–1.99

The usual tool for removing shingles from a roof is a hand shovel which has a generally flat blade with a straight front edge. While the shovel does an acceptable job it does not have a suitable construction for leveraging the shingles off the roof since the blade is generally aligned with the handle. Further, the shovel does not have any suitable means for lifting and removing roofing nails that hold the shingles, and that are often left on the roof when the shingles are removed. Also the shovel has no means for cutting the shingles to aid in their removal.

Special tools for removing shingles are known as shown in U.S. Pat. No. 5,159,859 and in CA 2,120,878. However these known tools, as in U.S. Pat. No. 5,159,859, are very complicated and thus relatively expensive, or, as in CA 2,120,878 are not versatile to both lift shingles and remove nails.

SUMMARY OF THE INVENTION

It is the purpose of the present invention to provide several shingle removing tools that can be used to more easily remove shingles and roofing nails from a roof. The tools are simple in construction and relatively inexpensive to make. Several of the tools are versatile in being able to remove both shingles and nails. One of the tools is particularly suited for lifting nails, particularly those left in the roof when the shingles have been removed, and can also be used for lifting the shingles. Another of the tools is particularly suited for easily lifting the shingles, and can also be used to lift nails either in the shingles or left on the roof. Another tool is particularly adapted to be able to simply and easily cut the shingles to make them easier to handle when removing them. The tools can be sold and used individually. However it is preferred to have the tools sold together to provide a shingle removing tool kit.

The invention is particularly directed toward a shingle removing tool having a flat blade with a generally main quadratic area, the blade having a front edge and a back edge and parallel side edges joining the front and back edges. The front edge has a plurality of spaced apart slots extending inwardly from the front edge of the blade. The back edge also has at least two spaced-apart slots extending inwardly from the back edge of the blade. The slots are sized to readily receive the shanks of roofing nails but will not pass the heads of the nails. Handle receiving means are mounted on the blade near its rear edge and centrally on the blade, the handle receiving means extending upwardly and rearwardly at a shallow angle. The tool is used to lift up shingles and more particularly to lift up roofing nails either in the shingles or on the roof.

The invention is also directed toward a shingle removing tool having a flat blade with at least one slot in one of the front or back edges of the blade. The slot is wide enough to receive the shank of a roofing nail but narrower than the head of a roofing nail. The sides of the blade defining the slot are beveled in a manner to taper in thickness from a thin edge at the front of the slot to a thick edge at the back of the slot to form nail lifting surfaces on the sides of the slot.

The invention is further particularly directed toward a tool for cutting the shingles. The tool has a narrow, flat bottom blade that has a pointed front edge and a square rear edge with parallel side edges joining the front and back edges. A flange extends up from the center of the bottom blade. A top blade is mounted on the flange over the bottom blade. The top blade is parallel to the bottom blade and is spaced therefrom a distance greater than the normal thickness of the shingle layers on a roof. The front of the top blade can also be pointed. Cutting means are provided on the front of the vertical flange between the blades. The cutting means has a forwardly directed cutting edge. The tool is pushed through the shingles to have the cutting means cut them into manageable sections for removal from the roof.

BRIEF DESCRIPTION OF THE DRAWINGS

FIG. 11 is an exploded, perspective view of another embodiment of the tool shown in FIG. 8;

FIG. 12 is a detail plan view of the tool shown in FIG. 11;

FIG. 13 is a detail plan view of modified teeth in the blade of the tool;

FIG. 14 is a cross-section view taken along line 14—14 in FIG. 13;

FIG. 15 is a side view of a modified shingle cutting and removing tool;

DESCRIPTION OF THE PREFERRED EMBODIMENTS

Figure 1:
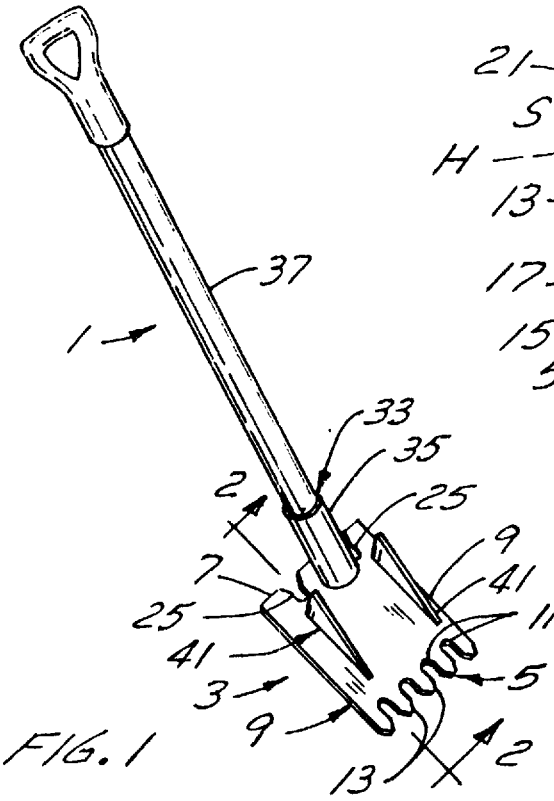
FIG. 1 is a perspective view of one shingle removing tool.
Figure 3:
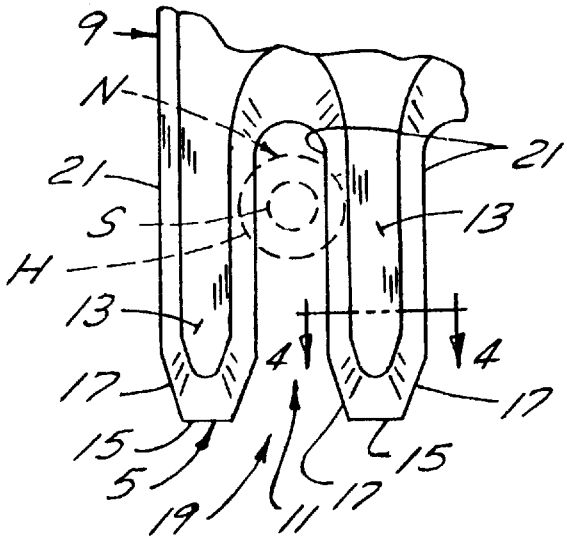
FIG. 3 is a detail plan view of the blade of the tool in FIG. 1.
Figure 4:
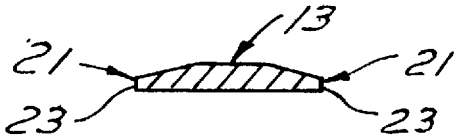
FIG. 4 is a cross-section view of a tooth taken along line 4—4 in FIG. 3.
Figure 2:
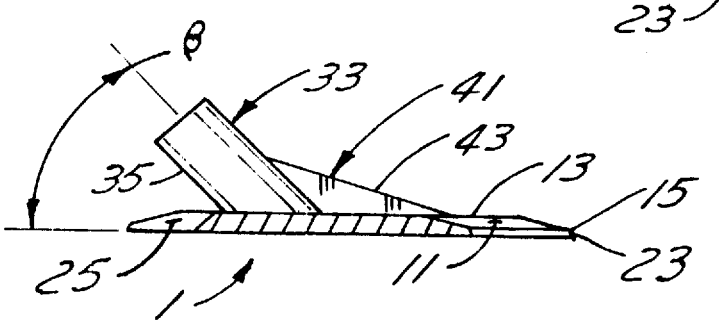
FIG. 2 is a cross-section view taken along line 2—2 of FIG. 1.

The shingle removing tool 1 shown in FIGS. 1 and 2 has a flat, metal, blade 3 with a generally rectangular shape. The blade 3 has a front edge 5, a back edge 7 and side edges 9. The blade 3 has a plurality of spaced apart, parallel slots 11 extending inwardly from the front edge 5 toward the back edge 7 for a short distance. The slots 11 form parallel fingers 13 in the front of the blade. Each slot 11 is wide enough to receive the shank "S" of a roofing nail "N" but narrow enough to prevent the passage of the head "H" of the roofing nail as shown in FIG. 3. The front 15 of each finger 13 is tapered in width as shown at 17 in FIG. 3 thus widening the entrance 19 to the slots 11. The fingers 13 also taper in thickness at their front 15 and sides 21 to a thin edge as shown at 23 in FIGS. 2 and 4.

A pair of slots 25 are also provided in the back edge 7 of the blade 3, one slot 25 adjacent each side edge 9 of the blade, the slots extending toward the front edge 5. These back slots 25 are the same size as the front slots 11 and the fronts of the slots are tapered to enlarge the entrance to the slots. While only two slots 25 have been shown in the back edge 7 of the blade 3, more slots could be provided in the back edge if desired. More slots would make it easier to catch a nail in a slot to remove it.

Handle attachment means 33 are provided on the blade 3. The handle attachment means 33 can comprise a short, tubular member 35 fastened to the blade 3 near its back edge 7 and centrally located between its side edges 9 and extending upwardly at a shallow angle β. The angle β is about 40° but can range between 30° and 45°. The lower end of a handle 37 for the tool is inserted into the tubular member 35 and fixed therein by suitable means such as a bolt (not shown).

If desired, the tool 1 could be provided with camming plates 41 on the upper surface of the blade 3. Two camming plates 41 are provided, one adjacent each side edge 9 of the blade 3 and parallel to the side edges 9 and each other. Each camming plate 41 is triangular in shape and has a camming edge 43 that slopes upwardly at a shallow angle from just behind the front slots 11 to close to the back slots 25.

The tool 1 is used to lift both shingles and the shingle nails off a roof and also to separate the shingles. The angle of the blade 3 relative to the handle 37 provides good leverage in lifting shingles and nails and the camming plates 41 help in lifting the shingles when the tool is pushed under the shingles. The tool is particularly suited for lifting nails. The nails are caught in one of the slots 11 in the front edge when the tool is pushed forwardly under the shingles. The tool can also be pushed forwardly or pulled rearwardly to catch, in the slots 11, 25, nails left in the roof after the shingles have been lifted off.

Figure 5:
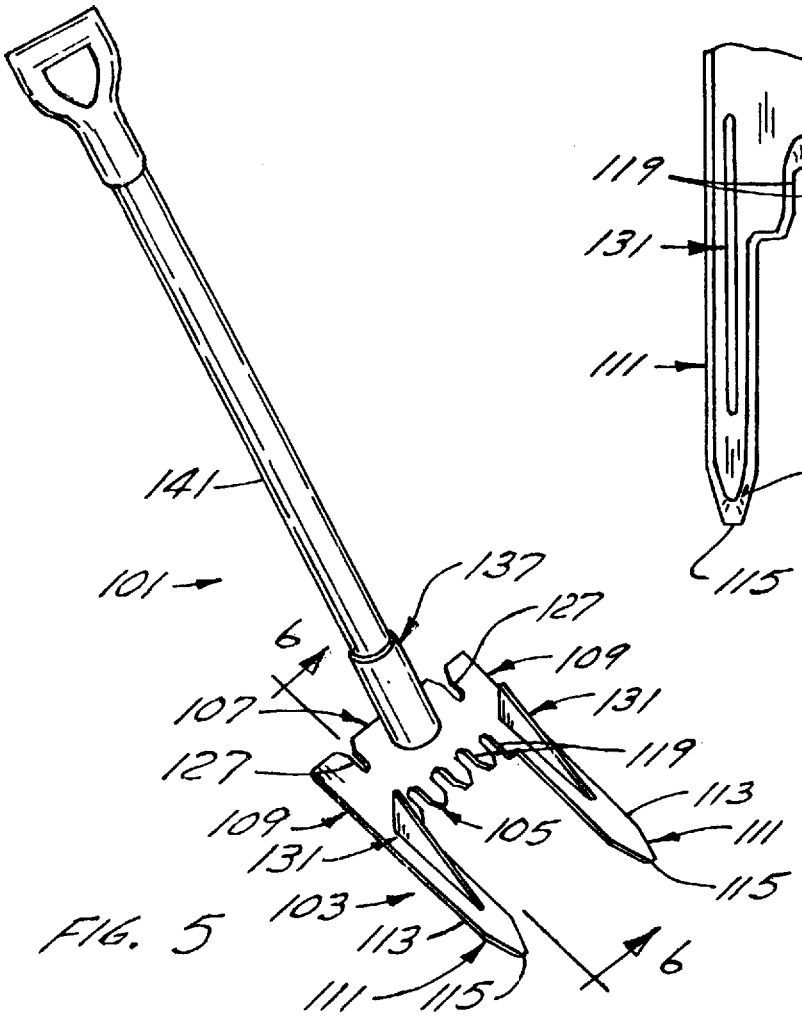
FIG. 5 is a perspective view of another shingle removing tool.
Figure 7:
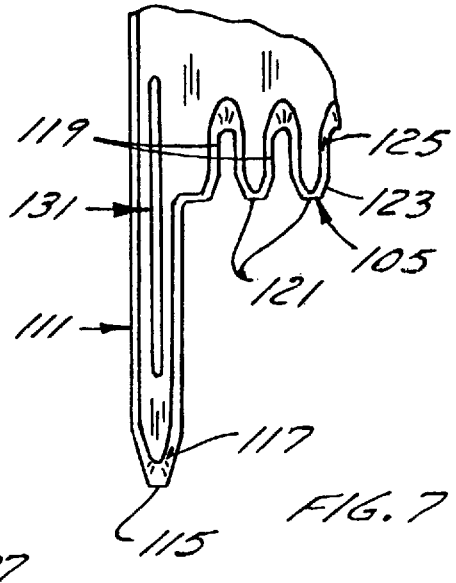
FIG. 7 is a detail plan view of the blade of the tool in FIG. 5.
Figure 6:
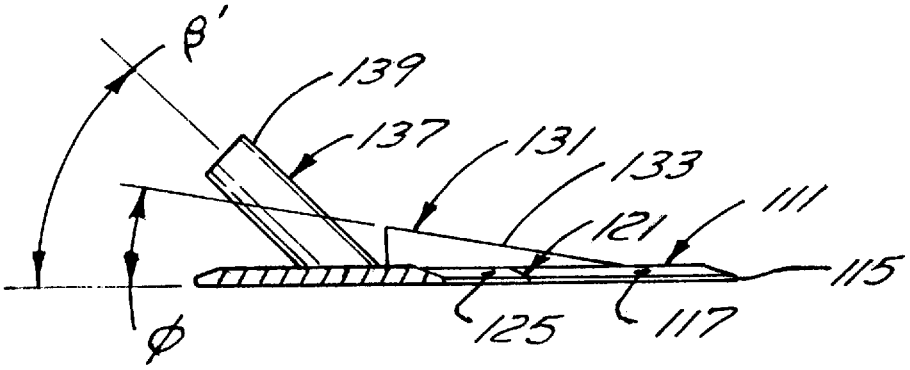
FIG. 6 is a cross-section taken along line 6—6 of FIG. 5.

A modified shingle removing tool 101, as shown in FIGS. 5 to 7, has a flat, metal blade 103 with a generally rectangular shape having a front edge 105, a rear edge 107 and side edges 109. The blade has a pair of elongate, parallel fingers 111 projecting forwardly from the front edge 105. The outer sides 113 of the fingers 111 form extensions of the side edges 109 of the blade 103 and are parallel to them. The edges of the outer ends 115 of the fingers taper in thickness as shown at 117 in FIG. 7. A plurality of spaced-apart, short, parallel slots 119 extend inwardly from the front edge 105, between the elongate fingers 111, toward the back edge. The slots 119 are the same as slots 11 and are wide enough to receive the shanks of roofing nails but narrow enough to prevent the passage of the heads of the nails. The slots form short, parallel fingers 121 in the front edge 105 of the blade between the elongate fingers 111. Each finger 121 is tapered in width as shown at 123 thus widening the entrance to the slots 119. The fingers 121 also taper in thickness at their front and sides to a thin edge as shown at 125. A pair of slots 127 can also be provided in the back edge 107 of the blade 103, one slot 127 adjacent each side edge 109 of the blade, the slots extending toward the front edge 105. These back slots 127 are generally the same size as the front slots 119 and the entrance to them is also enlarged.

A camming plate 131 is provided on each elongate finger 111. The camming plate 131 extends vertically up from the finger 111 and is centrally located thereon parallel to its sides. The camming plate 131 extends onto the main area of the blade 103. The camming plate 131 is triangular in shape and provides a camming top edge 133 that slopes up at a shallow angle ϕ from near the front of the finger. The angle ϕ is about 15° but can range between 10° and 20°.

The handle attachment means 137 are provided on the blade 103. The handle attachment means 137 can comprise a short tubular member 139 fastened to the blade 103 near its back edge 107 and centrally located between its side edges 109 and extending upwardly at a shallow angle β'. The angle β' is about 30° but can range between 25° and 40°. The lower end of a handle 141 for the tool is inserted into the tubular member 139 and fixed therein by suitable means such as a bolt (not shown). The tool 101 is used to lift both shingles and the roofing nails holding the shingles. This tool, with the elongated fingers 111, can more easily lift the shingles since the fingers easily slip under the shingles and the camming plates 131 will raise the shingles as the tool is pushed under the shingles. The handle 141 can then be raised to more easily release the shingle from the roof. The tool can be moved forwardly or rearwardly to catch the roofing nails in the front 119 or rear 127 slots.

Figure 8:
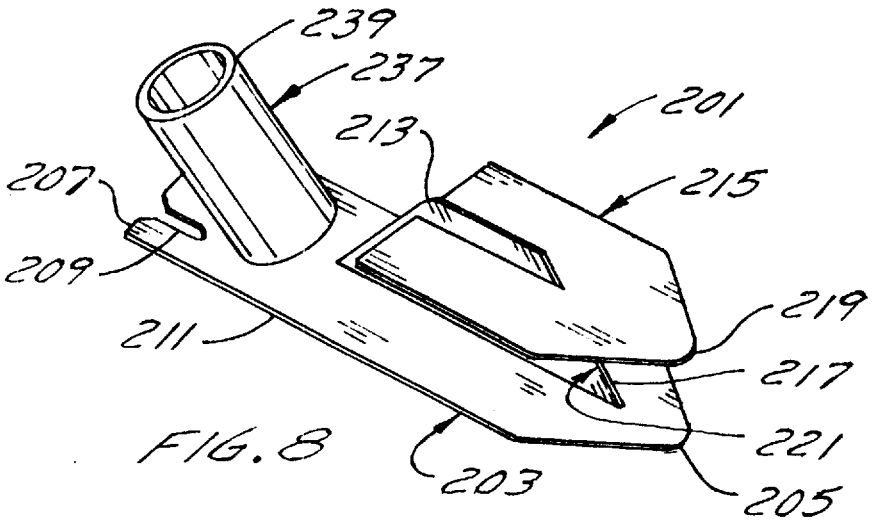
FIG. 8 is a perspective view of another shingle removing tool.
Figure 9:
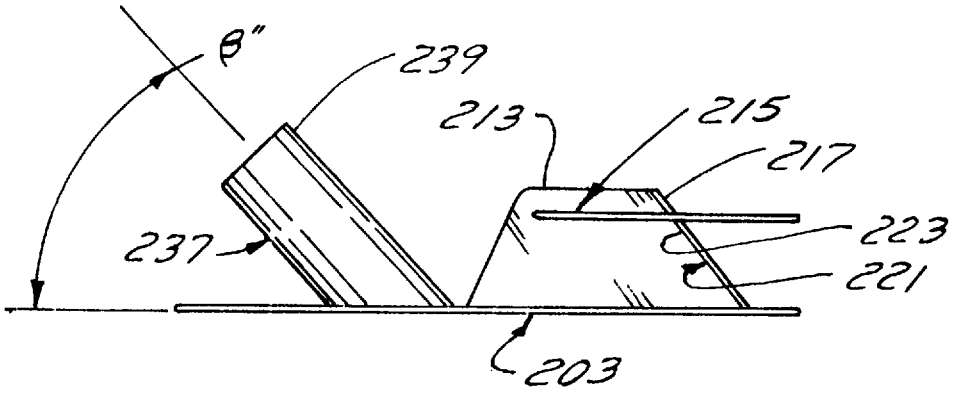
FIG. 9 is a side view of the tool shown in FIG. 8.
Figure 10:
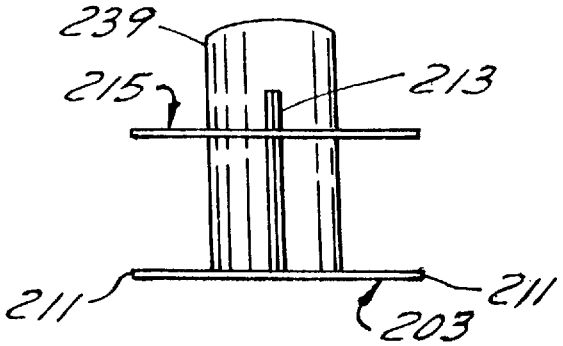
FIG. 10 is a front view of the tool shown in FIG. 8.

Another tool useful for removing shingles is a cutting tool 201 having, as shown in FIGS. 8 to 10, a flat bottom plate 203 that is somewhat elongate and pointed at its front end 205. The edges of the front end 205 can be tapered. The rear edge 207 is square and has two spaced-apart nail removing slots 209 extending inwardly therefrom toward the front. The slots 209 are parallel with the side edges 211 of the plate and are the same as the slots 25. A vertical flange 213 extends upwardly from the center of the bottom plate 203. The flange 213 supports a top plate 215 that is parallel to the bottom plate 203. The front edge 217 of the flange 213 is slopes rearwardly in rising to the top plate 215. The top plate 215 is spaced more than the normal thickness of the shingle layer on a roof from the bottom plate 203. The front 219 of the top plate 215 is also pointed. Cutting means 221 are provided on the front of the flange 213. The cutting means can comprise a cutting edge 223 formed on the front edge 217 of the flange. Handle attachment means 237 are provided on the top plate 215. The handle attachment means 237 can comprise a short tubular member 239 fastened to the top plate 215 near its back edge and centrally located between its side edges and extending upwardly at a shallow angle β". The angle β" is about 30° but can range between 20° and 40°. The lower end of a handle (not shown) for the tool is inserted into the tubular member 239 and fixed therein by suitable means such as a bolt (not shown).

In use, the tool 201 is pushed forwardly by the handle with the front end of the bottom plate 203 sliding under the shingles. The cutting edge 223 on the flange 213 cuts the shingles held between the bottom and top plates 203, 215 as the tool is pushed forward by the handle.

In a preferred embodiment, as shown in FIGS. 11 and 12 the cutting means 221' comprises a replaceable cutting blade 251 which can slide down a slot 253 in the top plate 215' just in front of the flange 213'. The back of the blade 251 has a groove 255 for receiving the front, unsharpened edge 217' of the flange 213. A groove 257 is also located in the top surface of the bottom plate 203' for receiving the bottom of the blade 251. A bolt 259, or other suitable means, locks the blade 251 in place when it rests in the groove 257. The bolt 259 passes through a hole 261 in the blade 251 and into a block 263 on the top plate 215' adjacent the slot 253. The front edge 265 of the blade 251 is a cutting edge for cutting the shingles. When the blade 251 gets dull, it is simply replaced.

The shingle removing tool shown in FIG. 1 can be modified to make it easier to lift the shingles. The modified tool, shown in FIGS. 13 and 14, has the portions of the blade adjacent the sides 21' of the fingers 13', defining the slots 11', beveled in a manner to taper in height from a thin edge 269 at the front edge 5' of the blade to a thick edge 271 at the base of the slot 11'. This provides the slots 11' with upward sloping, tapering, nail lifting surfaces 273 on their sides. Blades with these lifting surfaces 273 will partially lift roofing nails as the tool, flat on the roof, is pushed forward under the shingles. The partial prelifting of the nails makes it much easier to lift the shingles off the roof when the tool is then tilted to be used as a lifting lever, either before or after the shingles have been further lifted by the camming plates. The nail lifting surfaces also minimize shock forces normally encountered in jamming the tool under the shingle. With ordinary shovels, the front edge of the blade hits a nail and often shears it off, but there is resistance encountered in hitting the nail producing shock in the worker's arms. This is very tiring. With the present tool, when the nail is guided into the slots, the tool slows down as it pushed forwardly while the nail is being cammed up by the lifting surfaces and little shock is encountered in using the tool. The portion of the blade adjacent the slots 25 on the tool shown in FIG. 1 and adjacent both the front and rear slots 119, 127 of the tool shown in FIG. 5 can be similarly modified to have lifting surfaces 273 adjacent these slots.

The cutting tool, shown in FIGS. 8 to 10 can be modified to have the front cutting edge 217" of the flange 213" slope forwardly, as shown in FIG. 15, instead of rearwardly. The forward slope of the cutting edge 223" on the edge 217" forces the shingles to the junction 275 of the flange 213" and the bottom plate 203" to provide good cutting action. The tool with the forward slope on the front edge of the flange, can be used with a replacement blade, of the type shown in FIGS. 11 and 12, as well.

Figure 16:
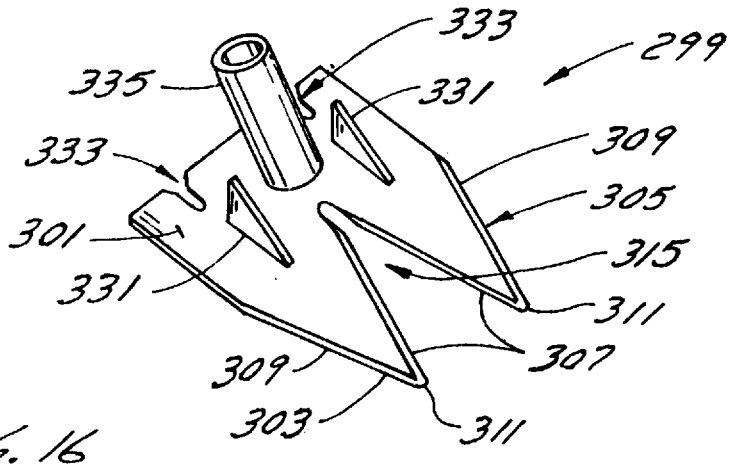
FIG. 16 is a perspective view of another embodiment of the tool.
Figure 18:
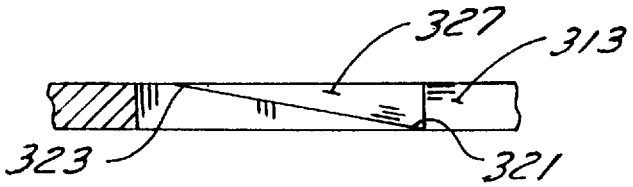
FIG. 18 is a cross-section view taken along line 18—18 in FIG. 17
Figure 17:
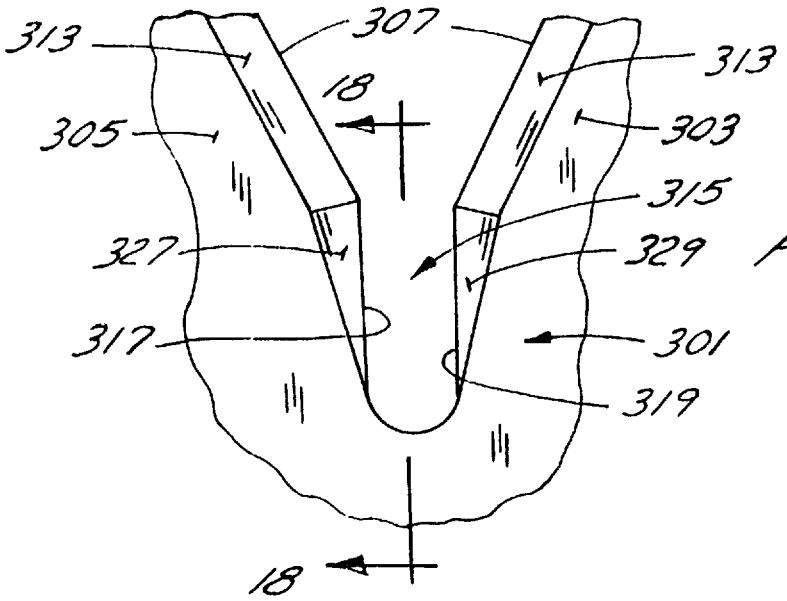
FIG. 17 is a detail top view of the tool shown in FIG. 16.

The shingle removing tool 299, in another embodiment as shown in FIGS. 16 to 18, has a flat metal blade 301 that is formed to have two adjacent front teeth 303, 305. The teeth 303, 305 are preferably slightly longer than their width and occupy roughly the front half of the blade. Each tooth 303, 305 is the same shape and has inner and outer sides 307, 309 angled toward each other to meet at a front point 311. The sides of the teeth are beveled, as shown at 313, to a thin edge.

A slot 315 extends rearwardly from between the teeth 303, 305 where their inner sides 307 converge. The slot 315 is wider than the shank of a roofing nail but narrower than the head of a roofing nail. The portion of the blade adjacent the sides 317, 319 of the slot 315 are beveled in a manner to taper in height from a thin edge 321 at the front of the slot 315 to a thick edge 323 at the base of the slot 315. This provides upward sloping, tapering, nail lifting surfaces 327, 329 adjacent the slot 315.

The tool can have triangular camming plates 331 on the top surface of the blade 301, one plate generally aligned with the point of each tooth 303, 305 and located just behind the slot 315. A pair of slots 333 similar to slots 25 on tool 1 or slots 127 on tool 101 could also be provided in the back edge of the blade 301. These slots could also be provided with upward sloping, tapering, nail lifting surfaces. The tool also includes a short tubular member 335 on the center of the blade 301 that extends upwardly and rearwardly for receiving a handle (not shown).

This tool 299 is very useful in removing one shingle at a time. The row of nails holding a shingle can be easily lifted one at a time using the lifting surfaces 327, 329 adjacent the slot which receives the nails. The beveled fingers slide easily under the shingle and the taper of the fingers guide the nails into the slot one at a time. The lifting surfaces partially lift the nails, and the camming plates complete the lifting of the nails. With the pointed teeth 303, 305 no nails are hit dead on and the shock factor is eliminated making it much easier for the worker.

The tools 1, 101, 201 and 299 preferably are sold in kit form for use in removing shingles. The tools each have specialized jobs to do and complement each other in removing shingles.

I claim:

1. A shingle removing tool having a flat blade with a generally main quadratic area having a front edge and a back edge and parallel side edges joining the front and back edges; the blade being made from a sheet of uniform thickness; the front edge having a plurality of spaced-apart slots extending inwardly from the front edge of the blade; the back edge having at least two spaced-apart slots extending inwardly from the back edge of the blade; the slots sized to readily receive the shanks of roofing nails but not to pass the heads of the nails; the slots on the front edge forming fingers with parallel sides; the fingers being tapered in width at their front ends to enlarge the mouths of the slots to a funnel shape; the sides of the fingers defining the slot, that extend rearwardly from the front ends, being substantially longer than the front ends of the fingers to locate the closed ends of the slots some distance from the front edge of the blade whereby when a nail in a roof is located at the closed end of a slot and the tool is pivoted up about its front edge on the roof, the nail is easily levered out of the roof.

2. A shingle removing tool as claimed in claim 1 wherein at least the tapered front end of each finger is tapered in thickness toward its front end.

3. A shingle removing tool as claimed in claim 1 wherein the sides of each finger, rearwardly from the tapered front end, are tapered toward the slot on each side of the finger thereby providing a sloping surface on each side of each slot, the sloping surfaces on the sides of each slot sloping the same amount to help center a nail being guided to the closed end of the slot by its head riding on the sloping surfaces.

4. A shingle removing tool as claimed in claim 2 wherein the sides of each finger, rearwardly from the tapered front end, are tapered toward the slot on each side of the finger thereby providing a sloping surface on each side of each slot, the sloping surfaces on the sides of each slot sloping the same amount to help center a nail being guided to the closed end of the slot by its head riding on the sloping surfaces.

5. A shingle removing tool as claimed in claim 1 wherein the sides of each finger, rearwardly from the tapered front end, are beveled from the front toward the back of the slots on each side of the finger to provide upwardly rising surfaces that both center a nail by its head during movement part way into the slot and partly raise the nail by camming the head, and thus the nail, upwardly as it moves down the slot toward its closed end.

6. A shingle removing tool as claimed in claim 2 wherein the sides of each finger, rearwardly from the tapered front end, are beveled from the front toward the back of the slots on each side of the finger to provide upwardly rising surfaces that both center a nail by its head during movement part way into the slot and partly raise the nail by camming the head, and thus the nail, upwardly as it moves down the slot toward its closed end.

7. A shingle removing tool having a flat blade with a generally main quadratic area having a front edge and a back edge and parallel side edges joining the front and back edges; the blade being made from a sheet of uniform thickness; the front edge having a plurality of spaced apart slots extending inwardly from the front edge of the blade; the back edge having at least two spaced-apart slots extending inwardly from the back edge of the blade; the slots sized to readily receive the shanks of roofing nails but not to pass the heads of the nails; the slots on the front edge forming fingers with parallel sides; the fingers being tapered in width at their front ends to enlarge the mouths of the slots to a funnel shape; the sides of the fingers defining the slot, that extending rearwardly past the front ends, being substantially longer than the front ends of the fingers to locate the closed ends of the slots some distance from the front edge of the blade whereby when a nail in a roof is located at the closed end of a slot and the tool is pivoted up about its front edge on the roof, the nail is easily levered out of the roof; the top of the blade having two triangular camming plates on it parallel to each side, transverse to the blade, and spaced inwardly from the sides; the front ends of the camming plates being pointed and located adjacent the closed ends of the slots.

* * * * *